US007617557B2

(12) United States Patent
Reindle

(10) Patent No.: US 7,617,557 B2
(45) Date of Patent: Nov. 17, 2009

(54) POWERED CLEANING APPLIANCE

(75) Inventor: Mark E. Reindle, Sagamore Hills, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 847 days.

(21) Appl. No.: 10/967,551

(22) Filed: Oct. 18, 2004

(65) Prior Publication Data

US 2005/0217042 A1 Oct. 6, 2005

Related U.S. Application Data

(60) Provisional application No. 60/559,186, filed on Apr. 2, 2004.

(51) Int. Cl.
*A47L 11/32* (2006.01)

(52) U.S. Cl. ..... 15/41.1; 15/52.1; 15/319

(58) Field of Classification Search ..... 15/52.1, 15/52, 41.1, 42, 319, 82, 83, 384
See application file for complete search history.

(56) References Cited

U.S. PATENT DOCUMENTS

| | | | | |
|---|---|---|---|---|
| 1,849,218 | A * | 3/1932 | Beach | 15/52.1 |
| 3,184,775 | A | 5/1965 | Downey et al. | |
| 3,587,127 | A | 6/1971 | Rosendall | |
| 4,084,283 | A | 4/1978 | Rosendall | |
| 4,306,329 | A | 12/1981 | Yokoi | |
| 4,325,156 | A * | 4/1982 | Rosendall | 15/41.1 |
| 4,369,539 | A | 1/1983 | Nordeen | |
| 4,369,543 | A | 1/1983 | Chen et al. | |
| 5,086,535 | A | 2/1992 | Grossmeyer et al. | |
| 5,095,577 | A | 3/1992 | Jonas et al. | |
| 5,109,566 | A | 5/1992 | Kobayashi et al. | |
| 5,208,935 | A * | 5/1993 | Jailor et al. | 15/41.1 |
| 5,239,721 | A | 8/1993 | Zahuranec | |
| 5,279,672 | A | 1/1994 | Betker et al. | |
| 5,341,540 | A | 8/1994 | Soupert et al. | |
| 5,435,031 | A * | 7/1995 | Minami et al. | 15/1.7 |
| 5,534,762 | A | 7/1996 | Kim | |
| 5,709,007 | A | 1/1998 | Chiang | |
| 5,720,077 | A | 2/1998 | Nakamura et al. | |
| 5,781,960 | A | 7/1998 | Kilström et al. | |
| 5,787,545 | A | 8/1998 | Colens | |

(Continued)

FOREIGN PATENT DOCUMENTS

| | | | |
|---|---|---|---|
| CN | 2 631413 | Y | 8/2004 |

(Continued)

OTHER PUBLICATIONS

Jeffrey Selingo, How It Works: Toward a Clean Sweep, Without the Human Touch, The New York Times Webpage, Mar. 4, 2004, pp. 1-2; http://www.nytimes.com.

*Primary Examiner*—Dung Van Nguyen
(74) *Attorney, Agent, or Firm*—Fay Sharpe LLP

(57) ABSTRACT

A powered sweeper includes a housing, a brushroll chamber disposed in the housing, a brushroll mounted in a brushroll chamber, a dirt chamber disposed in the housing, a drive motor disposed in the housing, and a driven wheel operatively connected to the drive motor. The brushroll rotates in the brushroll chamber and the dirt chamber communicates with the brushroll chamber such that debris is propelled by the brushroll into the dirt chamber.

29 Claims, 6 Drawing Sheets

U.S. PATENT DOCUMENTS

| | | | | |
|---|---|---|---|---|
| 5,940,927 | A | 8/1999 | Haegermarck et al. | |
| 5,940,930 | A | 8/1999 | Oh et al. | |
| 6,481,515 | B1 | 11/2002 | Kirkpatrick et al. | |
| 6,571,415 | B2 | 6/2003 | Gerber et al. | |
| 6,671,592 | B1 | 12/2003 | Bisset et al. | |
| 6,732,826 | B2 | 5/2004 | Song et al. | |
| 6,883,201 | B2 | 4/2005 | Jones et al. | |
| 7,225,500 | B2 * | 6/2007 | Diehl et al. | 15/319 |
| 7,320,149 | B1 * | 1/2008 | Huffman et al. | 15/319 |
| 7,346,428 | B1 * | 3/2008 | Huffman et al. | 700/245 |
| 2002/0116089 | A1 | 8/2002 | Kirkpatrick, Jr. | |
| 2003/0196294 | A1 * | 10/2003 | Conrad | 15/331 |
| 2004/0083570 | A1 * | 5/2004 | Song et al. | 15/319 |
| 2004/0143927 | A1 | 7/2004 | Haegermarck et al. | |
| 2004/0143930 | A1 | 7/2004 | Haegermarck | |
| 2005/0011028 | A1 | 1/2005 | Chow | |

FOREIGN PATENT DOCUMENTS

| | | |
|---|---|---|
| EP | 1 265 119 | 3/2005 |
| WO | WO 99/28800 | 6/1999 |
| WO | WO 02/39868 | 5/2002 |
| WO | WO 02/067744 | 9/2002 |
| WO | WO 03/024292 A2 | 3/2003 |
| WO | WO 03/026474 | 4/2003 |
| WO | WO 01/91623 A2 | 10/2003 |
| WO | WO 2004/016400 | 2/2004 |

* cited by examiner 184
206
16
28
28
32
32
26
74
24
18
78
94
36
36
222
138
132
142
134
136
76
72
172
182
232
236
122
124
178
126
238
246
178
144
234
252
176
244
102
248
162
242
174
214
216
254
104
226
202
226
202
218
106
226
168
202
204
38
164
156
204
152
166
22
204
186
154
146
194
192
148
188
118
108
116
128
114
112

212
66
68
70

POWERED CLEANING APPLIANCE

This application claims the benefit of U.S. Provisional Patent Application Ser. No. 60/559,186, filed Apr. 2, 2004, the disclosure of which is incorporated herein by reference.

BACKGROUND OF THE INVENTION

Cleaning appliances having a powered drive mechanism are known. For example, many vacuum cleaners include motors to propel the vacuum cleaner across a surface to be cleaned. Some of these vacuum cleaners include a handle to allow a user to maneuver the vacuum cleaner. Other vacuum cleaners are autonomously propelled. Autonomous vacuum cleaners receive directions via a remote signal or they can be programmed to move across a floor.

In addition to automatically propelled vacuum cleaners, sweepers having a powered brushroll are also known. Typically, a motor drives the brushroll. The brushroll rotates and contacts dirt and other debris to propel it into a dust cup located adjacent the brushroll.

SUMMARY OF THE INVENTION

According to a first embodiment of the invention, a powered sweeper includes a housing, a brushroll chamber disposed in the housing, a brushroll mounted in the brushroll chamber, a dirt chamber disposed in the housing, a drive motor disposed in the housing, and a driven wheel operatively connected to the drive motor. The brushroll rotates in the brushroll chamber. The dirt chamber communicates with the brushroll chamber such that debris is propelled by the brushroll into the dirt chamber.

According to another embodiment of the invention, an autonomous cleaning appliance includes a housing, a dirt container disposed in the housing, a brushroll chamber formed in the housing, a brushroll disposed in the brushroll chamber, a brushroll motor disposed in the housing, a power drive assembly mounted in the housing, and a control device that regulates the operation of the brushroll motor and the power drive assembly. The dirt container includes a dirt inlet and does not communicate with a suction source. The brushroll chamber communicates with the dirt inlet to allow debris to travel from the brushroll chamber into the dirt container. The power drive assembly propels the appliance.

According to yet another embodiment of the invention, an autonomous appliance includes a housing, a bumper mounted to the housing, a socket associated with one of the housing and the bumper, an extension associated with the other of the housing and the bumper, a sensor connected to the housing or the bumper, a dirt chamber disposed in the housing, a brushroll disposed in the housing, a power train assembly disposed in the housing, and a control device that regulates the operation of the power train assembly based on input from the sensor. The extension is received in the socket to control the movement of the bumper in relation to the housing.

BRIEF DESCRIPTION OF THE DRAWINGS

A powered cleaning appliance can take form in certain components and structures, an embodiment of which will be illustrated in the accompanying drawings.

DETAILED DESCRIPTION

Figure 1:
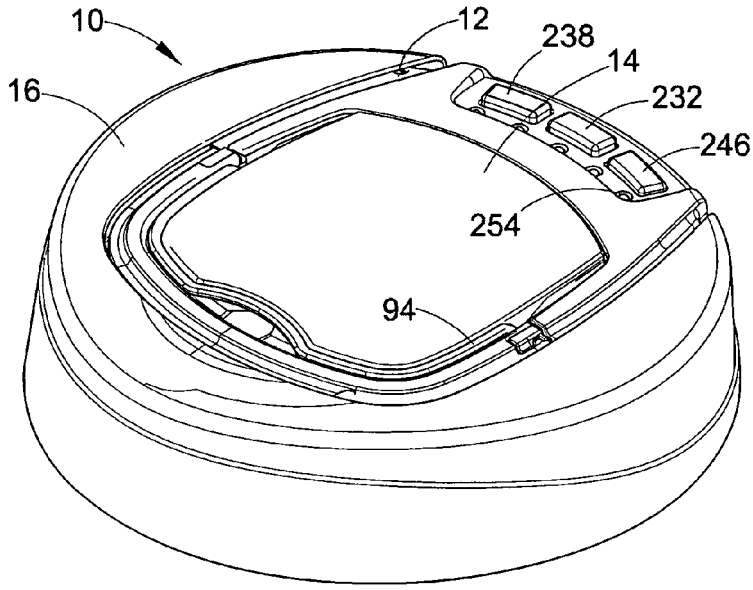
FIG. 1 is a perspective view of a powered cleaning appliance according to an embodiment of the invention.

A powered appliance 10 includes a housing 12, a removable dirt cup 14 located in the housing, a brushroll assembly located in housing, a drive assembly located in the housing, and a bumper 16 mounted to the housing. The appliance 10 will be described as an autonomous sweeper since in the depicted embodiment it does not include a suction source like that of a conventional vacuum cleaner. Alternative embodiments could include a suction source, such as a motor driven fan, that would direct airflow into the dirt cup 14. Furthermore, the appliance 10 will be described as having no upright handle to allow a user of the appliance to direct the movement of the appliance, similar to a conventional upright vacuum cleaner. Nevertheless, if desired, a handle can easily be attached to the appliance for directing its movement.

In the depicted embodiment, the housing 12 of the appliance 10 can be a generally circular plastic casing that encloses internal components of the appliance. With reference the FIG. 3, the housing includes a cover 18 that attaches to a base 22 in a manner that will be described below. The cover 18 includes a rectangular central opening 24 that is shaped to receive the dirt cup 14. A handle 26 attaches to the cover 18 via fasteners 28 and handle clamps 32. The handle 26 can be generally U-shaped and two clamps 32, one at each end of the handle, can attach the cover 18 so that the handle 26 can pivot in relation to the cover 18. The cover 18 also includes a plurality of openings 36 that can be tapered (more clearly visible in FIG. 4) to facilitate attachment of the cover 18 to the base 22 as well as the housing 12 to the bumper 16.

Figure 5:
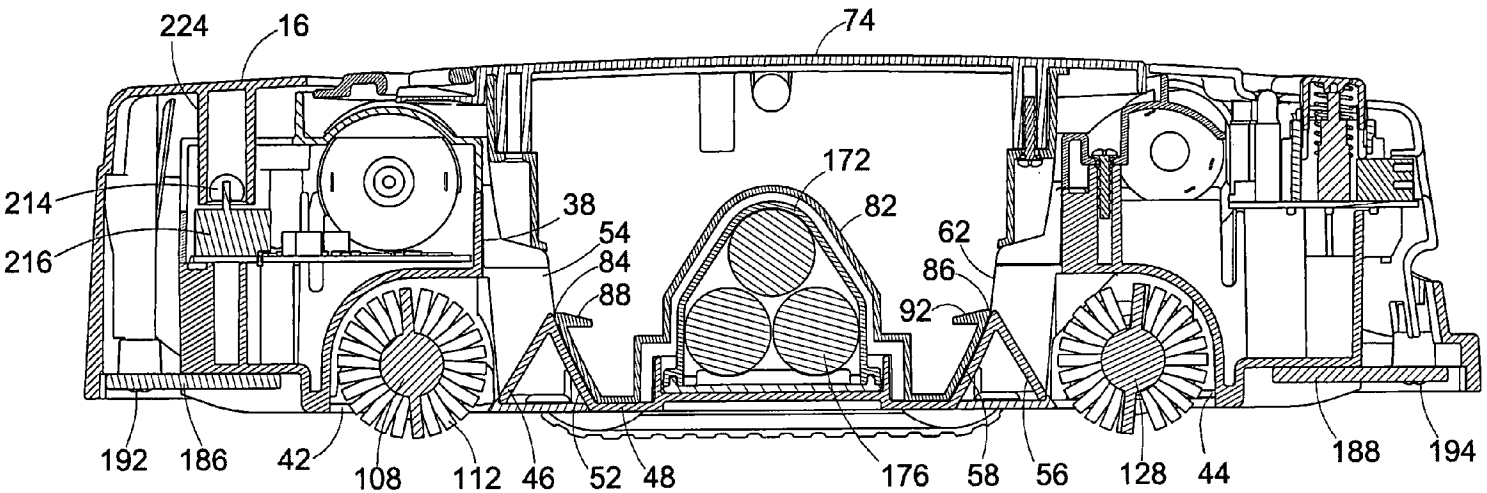
FIG. 5 is another cross-sectional view of the powered cleaning appliance of FIG. 6 taken at line 5-5 with the appliance oriented in its use position.

The base 22 of the housing 12 can also be generally circular and include a central cavity 38 that is dimensioned to receive the dirt cup 14. With reference to FIG. 5, the base 18 defines a first brushroll chamber 42 positioned on a first side of the central cavity 38 and a second brushroll chamber 44 positioned on an opposite side of the central cavity 38. A first upwardly angled wall 46 extends from a base wall 48 of the base 18 towards the central cavity 38 and a downwardly angled wall 52 connects to the first wall 46 and the base wall 48. Wall 46 is referred to as upwardly angled because dirt traveling into the dirt cup 14 moves upward in relation to the base wall 48 and through a dirt inlet 54 en route to the dirt cup. With respect to the second brushroll chamber 44, an upwardly angled wall 56 extends from the base wall 48 and connects to a downwardly angled wall 58. The second brushroll chamber 44 also communicates with an inlet opening 62 that communicates with the dirt cup 14. As more clearly seen in FIG. 6, the base wall 48 of the base 18 also includes a large generally rectangular opening 64 between the brushroll chambers to receive a power source for the appliance 10, which will be described in more detail below. A nozzle guard 66 can also attach to the base wall 48 via fasteners 68. The nozzle guard 66 includes a central opening 70 aligned with the opening 64 in the base.

Figure 3:
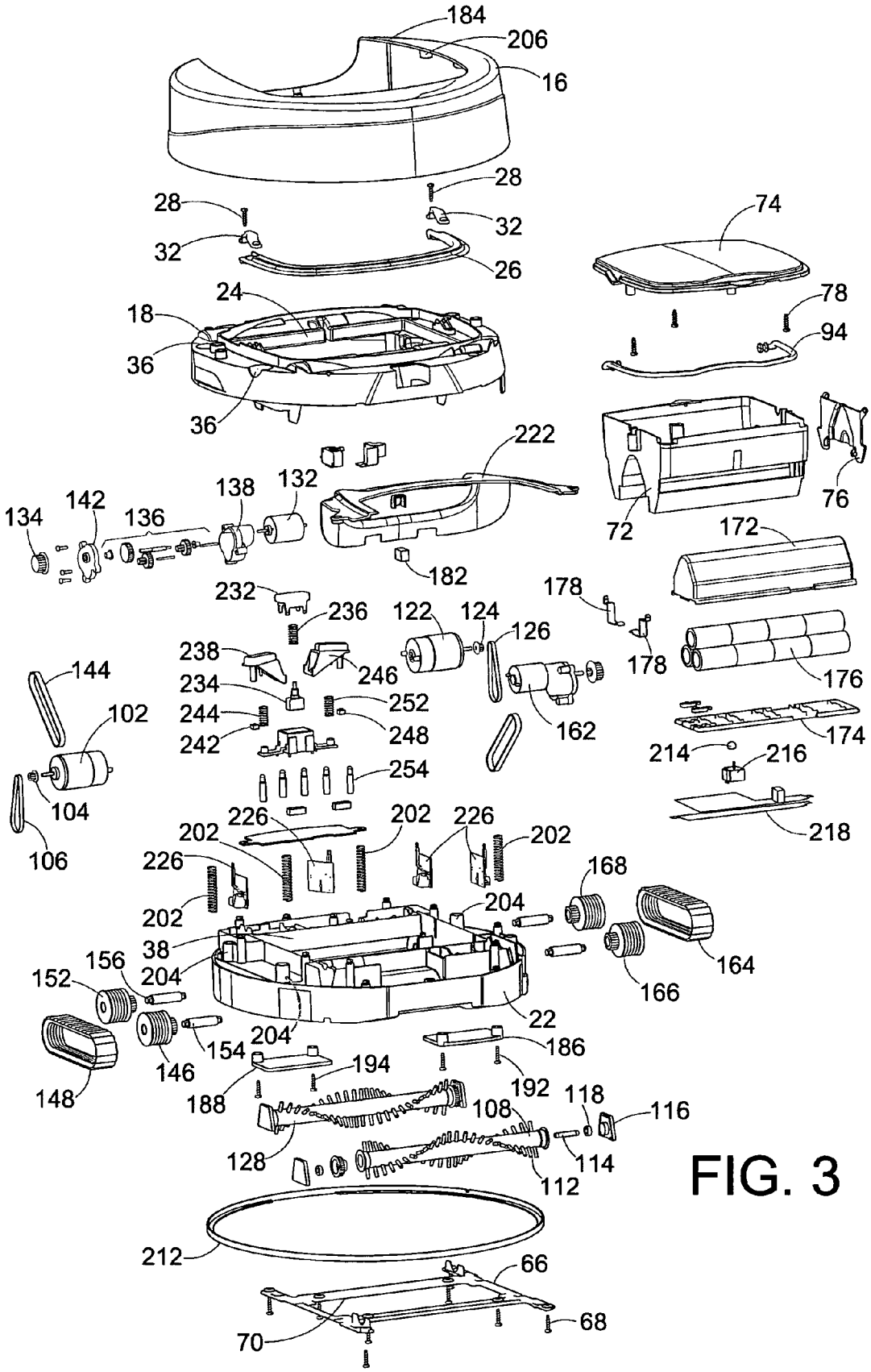
FIG. 3 is an exploded view of the powered cleaning appliance of FIG. 1.
Figure 4:
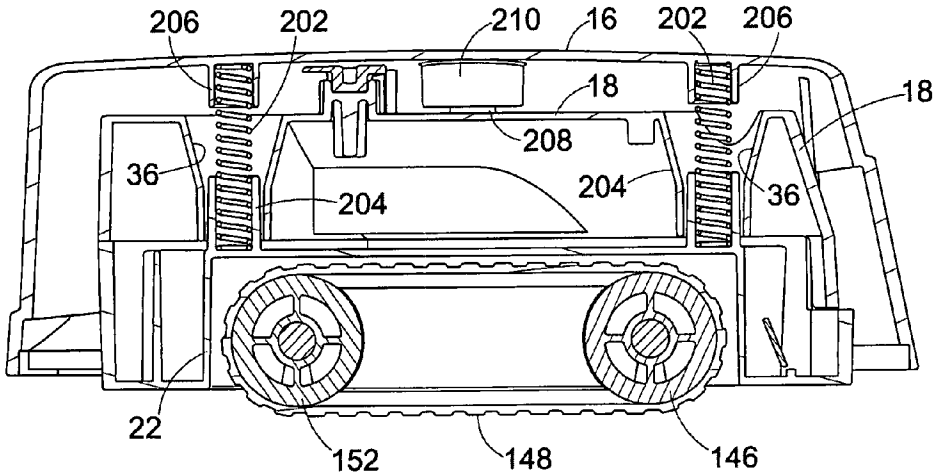
FIG. 4 is a cross-sectional view of the powered cleaning appliance of FIG. 6 taken at line 4-4 with the appliance oriented in its use position.

As indicated above, in the embodiment disclosed, the dirt cup 14 is received through the central opening 24 of the cover 18 and in the central cavity 38 of the base 22. With reference to FIG. 3, the dirt cup can include a generally W-shaped housing 72 to which both a dirt cup lid 74 and a dirt cup door 76 mount. The dirt cup lid 74 attaches to the top of the dirt cup housing 72 via conventional fasteners 78 (FIG. 3), or other conventional manners. The dirt cup door 76 mounts to a side of the dirt cup housing 72 and allows for easy emptying of the dirt cup when it gets full. While a W-shaped housing is disclosed, it should be appreciated that the housing could instead by rectangular in cross-section if the power pack of the cleaning appliance were relocated. If this were done the dirt cup could hold more dirt before needing to be emptied.

In the embodiment illustrated in FIG. 5, the dirt cup housing 72 includes an upwardly arched lower wall 82 to accommodate the power source, which will be described in more detail below. The dirt cup housing 72 also includes two inlet openings: a first inlet opening 84 that communicates with the first brushroll chamber 42 and a second inlet opening 86 that communicates with the second brushroll chamber 44. With reference to FIG. 5, inside the dirt cup 14 a first shelf 88 extends inwardly from a lower edge of the first inlet 84 and second shelf 92 extends inwardly from the second inlet opening 86. The shelves 88, 92 help retain the dirt inside of the dirt cup 14 and prevent the dirt from falling out of the inlet openings 84, 86 and back into the respective brushroll chamber.

Figure 7:
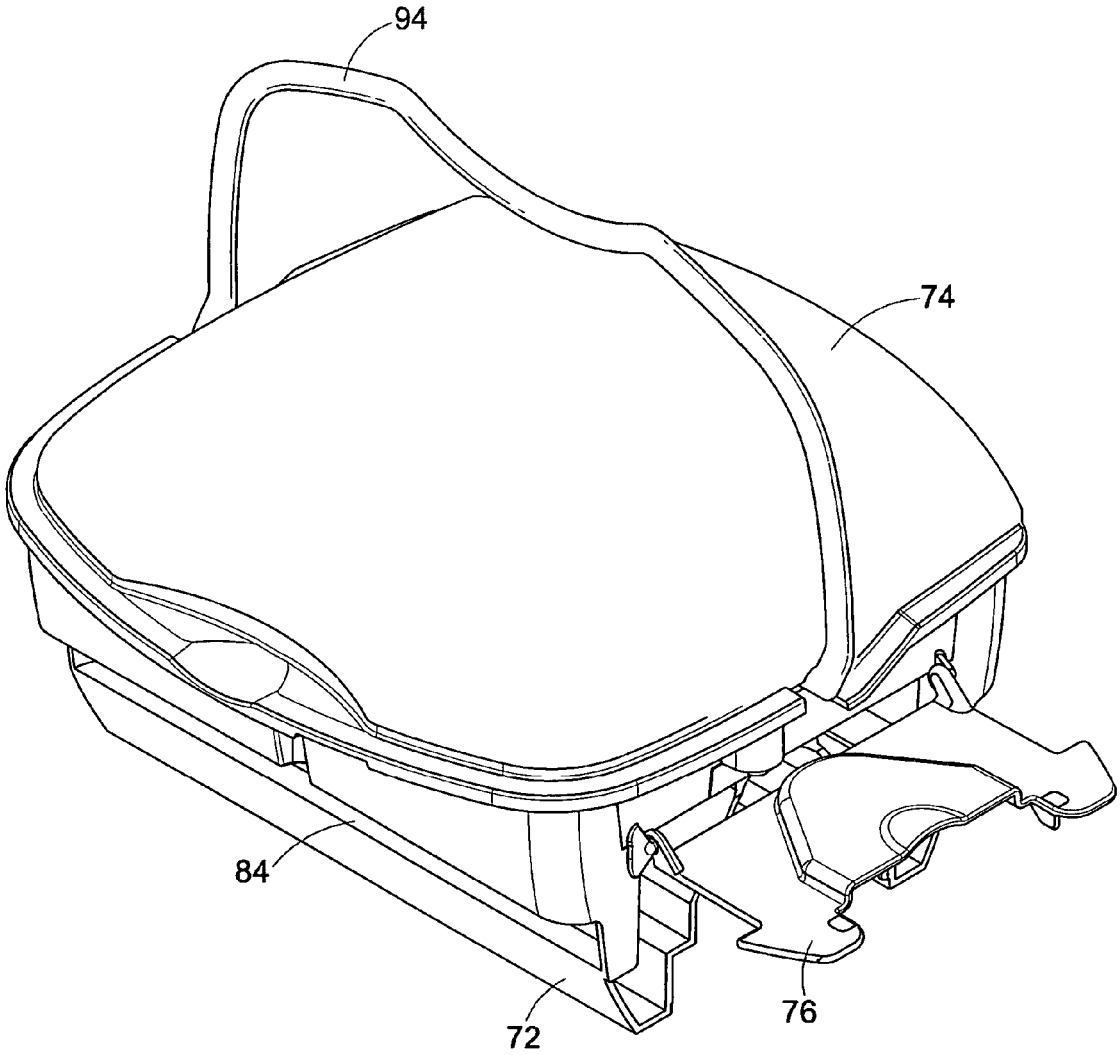
FIG. 7 is a perspective view of a dirt cup for use with the powered cleaning appliance of FIG. 1 with a door of the dirt cup open.

As most clearly seen in FIG. 7, the dirt cup door 76 hingedly attaches to the dirt cup housing 72 so that it can pivot between an open position and a closed position. A dirt cup handle 94 attaches to the dirt cup housing 72 and can pivot between a stored position (FIG. 1) where the handle is positioned slightly below the dirt cup lid 74 in a recessed area and an extended position, shown in FIG. 2, to facilitate removal of the dirt cup 14 from the housing 12.

As mentioned, the dirt cup 14 can take alternative configurations. For example, in lieu of the door 76, the dirt cup can include a removable dirt cup tray that can slide into the bottom of the dirt cup housing. The dirt cup tray can be removed when the user desires to empty the dirt cup. Other possible configurations include a hinged lid that can open so that the contents of the dirt cup can be dumped out from the top of the dirt cup.

With reference back to the embodiments depicted in the figures, two brushroll assembles are provided to propel dust and dirt into the dirt cup 14. With reference to FIG. 3, a first brushroll motor 102 drives a pinion 104 that engages a toothed belt 106. The brushroll motor 102 rests in a compartment defined in the housing 12, and more specifically in the base 22. The brushroll belt 106 engages a toothed portion of a brushroll dowel 108 that has plurality of bristles 112 extending from it. The brushroll dowel 108 rotates about a brushroll shaft 114 that mounts to an end cap 116. Also adjacent the end cap 116, a brush bearing 118 mounts on the brushroll shaft 114. The end cap 116 mounts inside the first brushroll chamber 42 (FIG. 5) so that the brushroll dowel 108 can rotate within the brushroll chamber. Another end cap and brush bearing are disposed at an opposite end of the brushroll dowel 108 and for the sake of brevity will not be described in further detail. This other end cap also mounts in the first brushroll chamber 42. The nozzle guard 66 sandwiches the end caps into the housing.

A second brushroll assembly made up of a second brushroll motor 122, a pinion 124 and a belt 126 is disposed on opposite side of the housing 12 and the dirt cup 14 as the similar components of the first brushroll assembly. The second brushroll motor 122 also rests in a compartment formed in the housing 12. The belt 126 drives a second brushroll dowel 128 that is disposed on an opposite side of the dirt cup 14 from the first brushroll dowel 108. The second brushroll dowel 128 is disposed in the second brushroll chamber 44 (FIG. 5) in a manner similar to the first brushroll chamber 108 described above and therefore will not be described in further detail. Even though brushroll assemblies have been described as each having a pinion that drives a toothed belt, the brushroll motor can drive the brushroll through interengagaing gears or another known transmission.

Turning now to the manner in which the appliance moves across the floor, a drive assembly propels the appliance 10. In the embodiment disclosed, a first drive motor 132 drives a drive sprocket 134 through a gear reduction transmission assembly 136 encased in a gear housing 138 and a gear housing cover 142. In this embodiment, the first drive motor 132 is a reversible electric motor. The drive sprocket 134 engages and drives a toothed drive belt 144, which drives a toothed first track pulley wheel 146. In turn, the first track pulley wheel 146 drives a first belt tread 148 that surrounds the first track pulley wheel 146 and a second track pulley wheel 152 spaced from the first track pulley wheel. The first and second track pulley wheels 146 and 152 receive first and second drive pins 154 and 156, respectively, that attach to the housing 12 so that the pulley wheels are attached to the housing.

A second drive motor 162 drives a second belt tread 164 through components similar to the drive assembly described above. The second belt tread 164 surrounds a first track pulley wheel 166 and a second track pulley wheel 168, both mounted to the housing 12. The second-belt tread 164 is disposed on an opposite side of the appliance 10 from the first drive tread 148 and can be driven independently thereof. Such a configuration allows for the appliance 10 to rotate about its central axis easily by driving one motor at one speed while driving the other motor at another speed or, perhaps, in the opposite direction. Because the appliance includes two separate drive assemblies, it can easily turn without the requirement of complicated differential gears and the like. In an alternative embodiment, the appliance 10 need not include the belt treads; instead the appliance could simply include one or more driven wheels that are driven through one or more suitable known transmissions.

Both the drive assemblies and the brushroll assemblies are driven by a power source. A rechargeable battery type power source is disclosed in this embodiment; however, the power source can be any conventional power source including an AC power source from a wall outlet, a solar power source, or a disposable battery power source. As most clearly seen in FIG. 5, a battery pack assembly can fit into the space below the arch shaped lower wall 82 of the dirt cup housing 72. With reference back to FIG. 3, an arch shaped battery pack housing 172 fits underneath the dirt cup housing 72. A removable lower lid 174 selectively attaches to the battery pack housing 172 and a plurality of batteries 176 can fit into the battery pack housing 172. Battery pack contacts 178 are provided to electrically connect the brushroll motors 104 and 122 and the drive motors 132 and 162 to the power source. Also, a charging jack 182 can be provided in electrical communication with the batteries 176 so that the batteries can be recharged.

In the depicted embodiment, the battery pack assembly is centrally located in the base 22 of the housing. If batteries are the desired power source, as mentioned, they can be located elsewhere in the housing, especially if an increase in the size of the dirt cup 14 is desired. As just one example, a set of batteries can be located toward each belt tread 148 and 164 or toward each brushroll chamber 42 and 44. The batteries could also be located elsewhere in the appliance, so long as they electrically connect to the brushroll assemblies and the drive assemblies.

The bumper 16 is movably mounted to the housing 12. In the depicted embodiment, the bumper 16 is a substantially circular shell that at least substantially surrounds the housing 12. The bumper 16 includes a central opening 184 that allows the dirt cup 14 to be lifted away from the housing 12 without having to remove the bumper. Two bottom brackets 186 and 188 are provided to attach the bumper 16 to the housing 12. Each bracket 186, 188 can be a generally rectangular plate having openings that receive fasteners to attach each bracket to the bumper. Fasteners 192 attach the first bottom bracket 186 to the bumper 16 and fasteners 194 attach the second bottom bracket 188 to the housing 16. As more clearly seen in FIG. 6, the first bracket 186 fits into a recess 196 formed in the bottom wall 48 of the base 22 of the housing 12. The recess 196 is generally rectangular in configuration, similar to that of the bracket 186, and is slightly larger than the bracket 186 to allow for movement of the bracket in the recess. Similarly, the second bottom bracket 188 fits into a second recess 198 in the bottom wall 48. The second recess 198 is similarly shaped to and on an opposite side of the appliance 10 from the first recess 196.

With reference to FIG. 3, a plurality of biasing members 202, which in this embodiment are coil springs, attach the housing 12 to the bumper 16. More specifically, the base 22 of the housing 12 includes a plurality of upwardly extending bosses 204 and the coil springs 202 receive the bosses such that the coil springs extend upwardly from the base 22. The tapered openings 36 in the cover 18 of the housing 12 receive the upwardly extending bosses 204 of the base 22 and the springs 202 that are mounted on the bosses. The bumper 16 includes a plurality of downwardly depending bosses 206 that receive the springs 202 so that the bumper 16 is resiliently coupled to the housing 12. In lieu of the coil springs other types of known resilient members, such as flexible plastic members, can be used to attach the bumper 16 to the housing 12.

Figure 2:
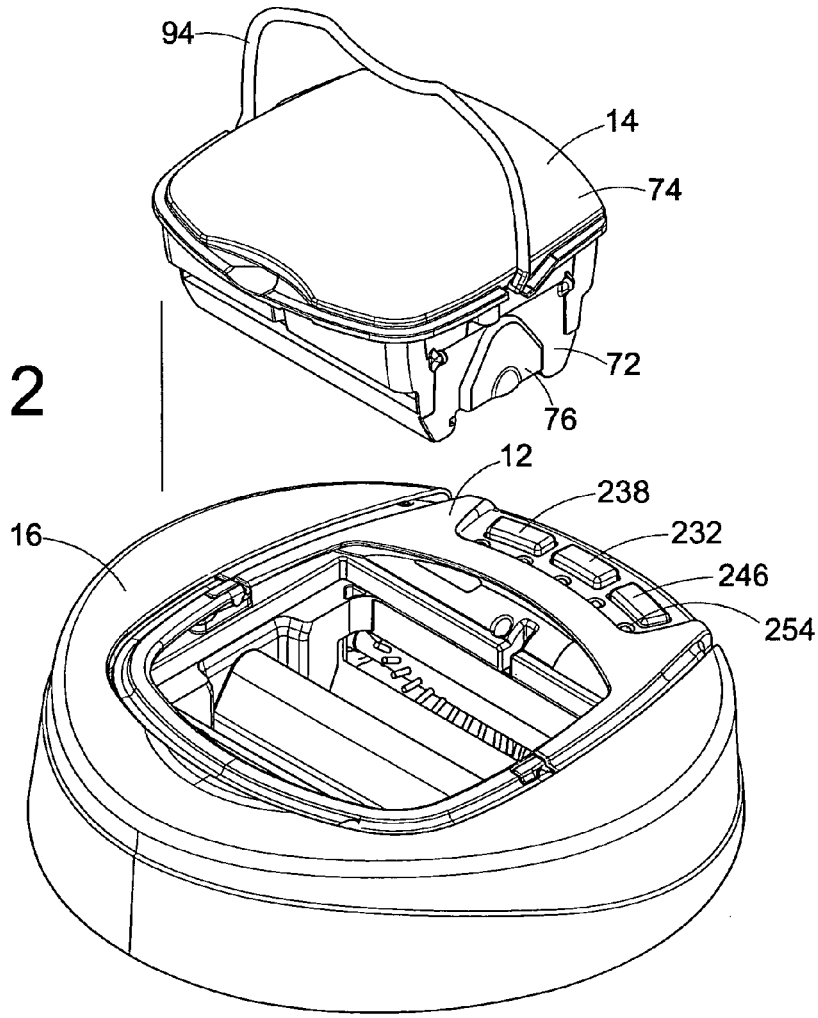
FIG. 2 is a perspective view of the powered cleaning appliance of FIG. 1 with a dirt cup removed from the appliance.
Figure 8:
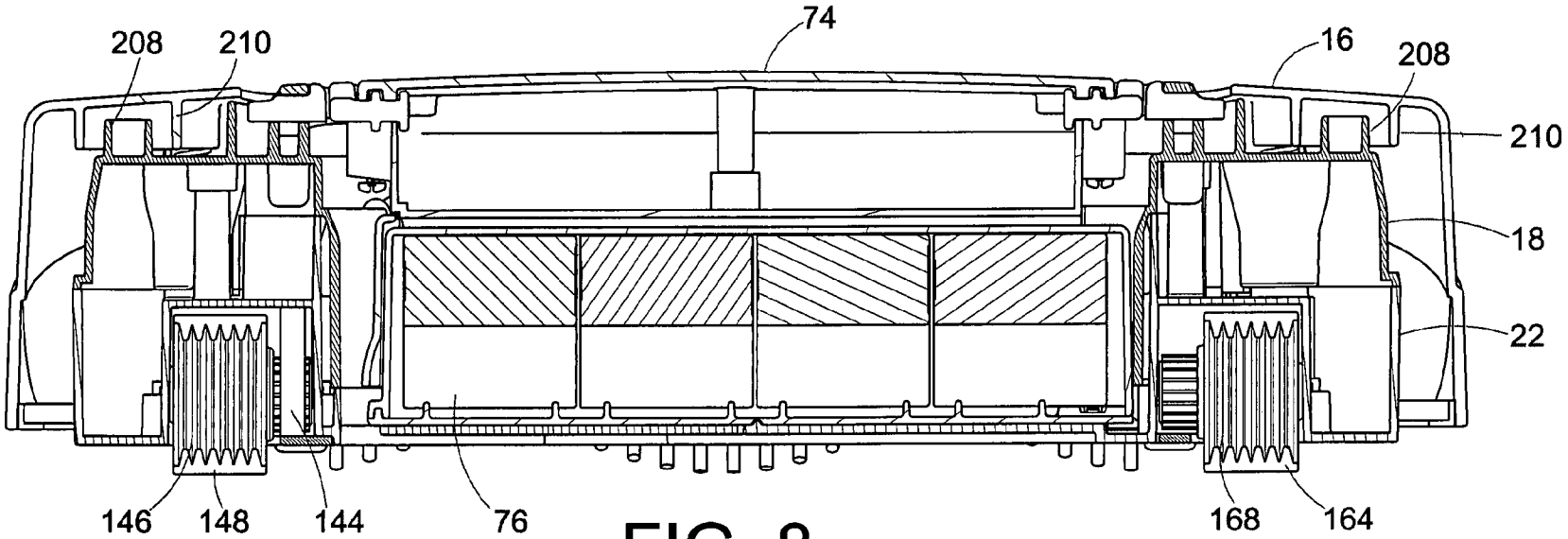
FIG. 8 is a cross-sectional view of the powered cleaning appliance of FIG. 6 taken at line 8-8 with the appliance oriented in its use position.
Figure 9:
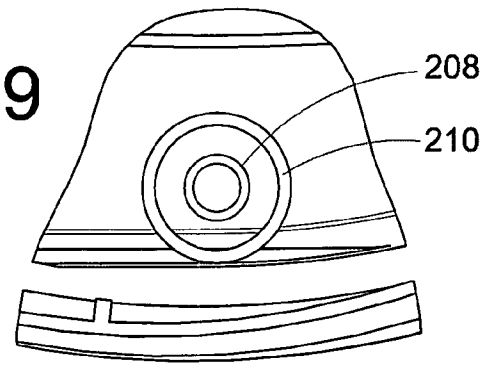
FIG. 9 is a top view of a cover stop boss and a bumper stop boss depicted in FIG. 8.

Movement of the bumper 16 in relation to the housing 12 is limited. With reference to FIG. 8, an extension or a cover stop boss 208 extends upwardly from the cover 18 of the housing 12 towards the bumper 16. A socket or bumper stop boss 210 extends downwardly from the bumper 16 and is received inside the cover stop boss 208. With reference to FIG. 9, bumper stop boss 210 has a diameter slightly larger than the cover stop boss 208 and is aligned concentrically with the cover stop boss 208 when the bumper 16 has no lateral force applied to it. In an alternative embodiment, the cover stop boss could receive the bumper stop boss, such that the socket and the extension arrangement can be reversed. In one embodiment, the radial space between the cover stop boss 208 and the bumper stop boss 210 is less than ¼ of an inch. Accordingly, movement of the bumper 16 in relation to the housing 12 is less than ¼ of an inch in any direction since the cover stop boss 208 and the bumper stop boss 210 are in a concentric circular configuration. With reference to FIG. 2, a bumper supporting ring 212 can attach to a lower edge of the bumper 16.

Movement of appliance 10 can be controlled by sensing the movement of the bumper 16 in relation to the housing 12. In one embodiment, a joystick sensor assembly is disclosed as the sensing device; however, other known motion sensors can be used. With reference to FIG. 5, a lever 214 mounts to a joystick sensor 216 which is an electrical communication with a main printed circuit board (PCB) 218 (FIG. 3). The main PCB 218 can mount to the base 22 of the housing 12 and can be covered by a board cover 222 that attaches the housing 12. Movement of the lever 214 on the joystick sensor 216 can result in a signal being sent from the sensor 216 to the main PCB 218, which can be an electrical communication with the drive motors 132 and 162 to control the movement of the appliance 10. Furthermore, a signal can also be sent, if desirable, to the brushroll motors 102 and 122 in response to movement of the lever 214 on the joystick sensor 216.

The bumper 16 includes a downwardly depending hollow cylindrical boss 224 that is dimensioned to receive the lever 214. Movement of the bumper 16 results in movement of the boss 224 which results in movement of the lever 214. An appropriate signal can be sent to the drive motors in response to movement of the lever. Examples of the types of signals that can be delivered by the sensor are further described in co-pending patent application entitled "Robotic Appliance with On-Board Joystick Sensor and Associated Methods of Operation" filed Sep. 21, 2004, which is incorporated herein by reference in its entirety.

In alternative embodiments, the location of the sensor assembly can be moved. For example, the joystick and lever shown in FIG. 5, can be mounted to the bumper and a boss can extend upwardly from the housing so that movement of the bumper will still result in movement of the lever. The joystick sensor would move with the bumper resulting in the lever moving while the boss would remain relatively stationary. Additionally, other known sensors, such as switch sensors and the like could be mounted to the bumper and/or the housing. For example, movement of the bumper in relation to the housing could activate an on/off type sensor that could deliver an appropriate signal to the main PCB.

Figure 6:
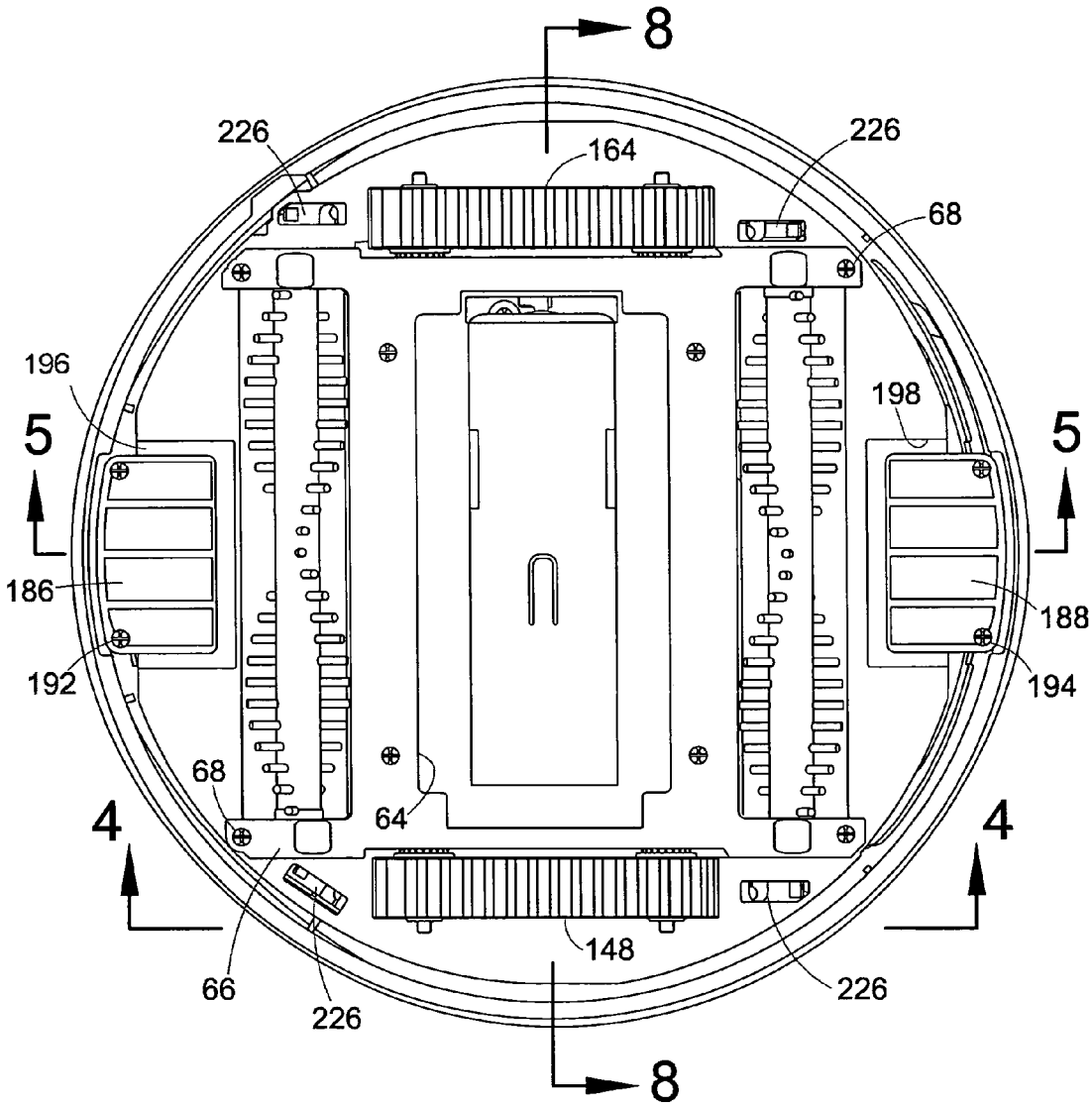
FIG. 6 is a bottom plan view of the powered cleaning appliance of FIG. 1.

Movement of the appliance 10 can also be controlled by floor sensor assemblies 226 that can deliver a signal to the drive motors 132 and 162 via the main PCB 218. As seen in FIG. 6, four floor sensor assemblies 226 can be provided where one floor assembly is located forward the first belt tread 148 and one floor sensor assembly is located forward the second belt tread 164. Also, one floor sensor assembly is located rearward the first belt tread 148, and one floor sensor assembly is located rearward the second belt tread 164. The floor sensor assemblies can include infrared sensors with an emitter and corresponding detector. The emitter can have a field of emission directed downward toward the floor at a location forward or rearward of the corresponding belt tread. The detector can have a field of view that can intersect the field of emission of the corresponding emitter so that off edge and loss of floor conditions can be detected before the robotic appliance, for example, becomes hung up in a depression or tumbles down a staircase. Of course, other types of known sensor assemblies could be used instead, is so desired.

A plurality of switches can be provided to control power to the motors as well as the mode in which the appliance will work. With reference back to FIG. 3, a power button 232 can be provided to activate a push button power switch 234 to control power to the motors. The power switch 234 is an electrical communication with the batteries 176 and the main PCB 218. A biasing member 236 can be provided to bias the power button 232 away from the power switch 234. Additionally, a start button 238 can activate a first momentary switch 242. The momentary switch 242 is in electrical communication with the power source 176 and the main PCB 218 to control power delivery to the drive motors 132 and 162. The start button 238 is biased by a spring 244 away from the momentary switch 242. Additionally, a mode button 246 can activate a second momentary switch 248 to control the mode in which the appliance works. Also, a biasing member 252 can be used to bias the mode button 246 away from the momentary switch 248. The mode button 248 is in electrical communication with the main PCB 218 to control, for example, whether only one brushroll motor or two brushroll motors will be activated. Other modes of operation can also be programmed into the main PCB 218. A plurality of indicator lights 254 can also be provided. The indicator lights 254 can also be in electrical communication with the batteries 176 and the main PCB 218. The indicator lights 254 can light up to indicate different modes of operation.

While the appliance has been described above with reference to certain embodiments, it is evident that many alternatives, modifications, and variations will be apparent to those skilled in the art upon reading and understanding the preceding description. The above embodiments are intended to be illustrative, rather than limiting, of the spirit and scope of the invention. It is intended that the invention embrace all alternatives, modifications, and alteration that fall within the spirit and scope of the appended claims and the equivalents thereof.

The invention clained is:

1. A powered sweeper comprising:

a housing;

a first brushroll chamber disposed in the housing;

a first brushroll rotatably mounted in the first brushroll chamber;

a dirt chamber disposed in the housing and communicating with the first brushroll chamber;

a first drive motor disposed in the housing;

a first driven wheel mounted to the housing and operatively connected to the first drive motor;

a bumper movably mounted to the housing; and, wherein at least one of the bumper and the housing includes a joystick in communication with a circuit board and the other of the bumper and the housing includes a socket that receives a distal end of the joystick.

2. The sweeper of claim 1, further comprising:

a first brushroll motor operatively connected to the first brushroll.

3. The sweeper of claim 2, further comprising:

a second brushroll chamber disposed in the housing on an opposite side of the dirt chamber from the first brushroll chamber; and a second brushroll disposed in the second brushroll chamber.

4. The sweeper of claim 3, further comprising:

a second brushroll motor operatively connected to the second brushroll.

5. The sweeper of claim 3, wherein the dirt chamber includes a first dirt inlet adjacent the first brushroll chamber and a second dirt inlet on an opposite side of the dirt chamber adjacent the second brushroll chamber.

6. The sweeper of claim 1, wherein the dirt chamber is defined by a dirt container that is removably mounted in the housing.

7. The sweeper of claim 1, further comprising:

a second drive motor disposed in the housing; and a second driven wheel operatively connected to the second drive motor, wherein the first driven wheel is positioned on a first side of the dirt chamber and the second driven wheel is positioned on a second side of the dirt chamber, wherein the first side is opposite the second side.

8. The sweeper of claim 7, wherein the first driven wheel drives a first tread belt and the second driven wheel drives a second tread belt.

9. The sweeper of claim 1, wherein the first drive motor comprises a reversible electric motor.

10. The sweeper of claim 1, wherein the first drive motor is in electrical communication with a switch to control direction of rotation of the motor.

11. The sweeper of claim 1, wherein the bumper comprises a shell that at least substantially encircles the housing.

12. The sweeper of claim 1, wherein at least one of the bumper and the housing includes an extension and the other of the bumper and the housing includes a socket that receives the extension, wherein the extension selectively contacts the socket to limit movement of the bumper in relation to the housing.

13. The sweeper of claim 12, wherein the socket is approximately cylindrical and the extension contacts a radial wall of the socket to limit movement of the bumper in relation to the housing.

14. The sweeper of claim 1, wherein the dirt chamber does not communicate with a suction source.

15. A powered sweeper comprising:

a housing;

a bumper movably mounted to the housing, wherein at least one of the bumper and the housing includes a joystick in communication with a circuit board and the other of the bumper and the housing includes a socket that receives a distal end of the jovstick;

a first brushroll chamber disposed in the housing;

a first brushroll rotatably mounted in the first brushroll chamber;

a dirt chamber supported by the housing and communicating with the first brushroll chamber;

a first drive motor supported by the housing;

a first driven wheel mounted to the housing and operatively connected to the first drive motor;

a second drive motor supported by the housing;

a second driven wheel operatively connected to the second drive motor, wherein the first driven wheel is positioned on a first side of the dirt chamber and the second driven wheel is positioned on a second side of the dirt chamber, wherein the first side is opposite the second side;

a first belt tread driven by the first driven wheel; and a second belt tread driven by the second driven wheel.

16. The sweeper of claim 15, further comprising:

a first brushroll motor operatively connected to the first brushroll.

17. The sweeper of claim 16, further comprising:

a second brushroll chamber disposed in the housing on an opposite side of the dirt chamber from the first brushroll chamber; and a second brushroll disposed in the second brushroll chamber.

18. The sweeper of claim 17, further comprising:

a second brushroll motor operatively connected to the second brushroll.

19. The sweeper of claim 17, wherein the dirt chamber includes a first dirt inlet adjacent the first brushroll chamber and a second dirt inlet on an opposite side of the dirt chamber adjacent the second brushroll chamber.

20. The sweeper of claim 15, wherein the dirt chamber does not communicate with a suction source.

21. The sweeper of claim 15, wherein the first drive motor is in electrical communication with a switch to control direction of rotation of the motor.

22. The sweeper claim 15, wherein the bumper comprises a shell that at least substantially surrounds the housing.

23. The sweeper of claim 15, wherein at least one of the bumper and the housing includes an extension and the other of the bumper and the housing includes a socket that receives the extension, wherein the extension selectively contacts the socket to limit movement of the bumper in relation to the housing.

24. The sweeper of claim 23, wherein the socket is approximately cylindrical and the extension contacts a radial wall of the socket to limit movement of the bumper in relation to the housing.

25. The sweeper of claim 15, wherein the first belt tread and the second belt tread are positioned to contact an associated floor that is to be cleaned by the sweeper.

26. A powered sweeper comprising:

a housing;

a first brushroll chamber disposed in the housing;

a first brushroll rotatably mounted in the first brushroll chamber;

a dirt chamber supported by the housing and communicating with the first brushroll chamber;

a first drive motor supported by the housing;

a first driven wheel mounted to the housing and operatively connected to the first drive motor; and a bumper movably mounted to the housing, wherein at least one of the bumper and the housing includes an extension and the other of the bumper and the housing includes a socket that receives the extension, wherein the extension selectively contacts the socket to limit movement of the bumper in relation to the housing, wherein the socket is approximately cylindrical and the extension contacts a radial wall of the socket to limit movement of the bumper in relation to the housing.

27. The sweeper of claim 26, wherein the bumper comprises a shell that at least substantially surrounds the housing.

28. The sweeper of claim 26, wherein the dirt chamber does not communicate with a suction source.

29. The sweeper of claim 26, further comprising a bumper plate attached to the bumper, wherein the bumper plate and the bumper sandwich the housing.

* * * * *

UNITED STATES PATENT AND TRADEMARK OFFICE

CERTIFICATE OF CORRECTION

PATENT NO. : 7,617,557 B2
APPLICATION NO. : 10/967551
DATED : November 17, 2009
INVENTOR(S) : Mark E. Reindle It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1428 days.

Signed and Sealed this

Nineteenth Day of October, 2010

David J. Kappos

David J. Kappos
*Director of the United States Patent and Trademark Office*